US005172759A

United States Patent [19]

Shimoya et al.

[11] Patent Number: 5,172,759

[45] Date of Patent: Dec. 22, 1992

[54] PLATE-TYPE REFRIGERANT EVAPORATOR

[75] Inventors: Masahiro Shimoya, Chita; Tadashi Nakabou, Anjo; Yoshiyuki Yamauchi, Agui, all of Japan

[73] Assignee: Nippondenso Co., Ltd., Kariya, Japan

[21] Appl. No.: 905,877

[22] Filed: Jun. 29, 1992

Related U.S. Application Data

[62] Division of Ser. No. 603,623, Oct. 26, 1990, Pat. No. 5,137,082.

[30] Foreign Application Priority Data

Oct. 31, 1989 [JP] Japan ..... 1-285829
Sep. 17, 1990 [JP] Japan ..... 2-248518

[51] Int. Cl.[5] ..... F25B 39/02; F28F 13/08

[52] U.S. Cl. ..... 165/110; 165/153; 165/176; 165/903; 62/515

[58] Field of Search ..... 165/110, 147, 153, 176, 165/903; 62/515

[56] References Cited

U.S. PATENT DOCUMENTS

| | | | |
|---|---|---|---|
| 4,370,868 | 2/1983 | Kim et al. | 165/153 |
| 4,586,565 | 5/1986 | Hallstrom et al. | 165/147 |
| 4,696,342 | 9/1987 | Yamauchi et al. | 165/152 |
| 4,723,601 | 2/1988 | Ohara et al. | 165/153 |
| 4,821,531 | 4/1989 | Yamauchi et al. | 62/515 |

FOREIGN PATENT DOCUMENTS

| | | | |
|---|---|---|---|
| 73221 | 10/1951 | Denmark | 165/903 |
| 93387 | 5/1986 | Japan . | |

*Primary Examiner*—Albert W. Davis, Jr.
*Attorney, Agent, or Firm*—Cushman, Darby & Cushman

[57] ABSTRACT

A plate-type heat exchanger comprises a stack of flat tubes each composed of a pair of confronting core plates jointed to each other and defining a fluid passage. A cross sectional area of the fluid passage is increased along the flowing direction of tbe refrigerant. A plurality of ribs are disposed on the fluid passage. A flowing resistance of the ribs which are disposed near an outlet tank is lower than that of the ribs which are disposed near an inlet tank.

5 Claims, 6 Drawing Sheets

PLATE-TYPE REFRIGERANT EVAPORATOR

This is a division of application Ser. No. 07/603,623, filed Oct. 26, 1990 now U.S. Pat. No. 5,137,082.

BACKGROUND OF THE INVENTION

1. Field of the Invention

The present invention relates to a plate-type refrigerant evaporator especially used for an air-conditioner of automobile.

2. Description of the Prior Art

A conventional plate-type evaporator has a plurality of tubes each of which is formed by joining a pair of core plates so as to form a seal. An inlet tank portion and an outlet tank portion are also formed in the core plates.

FIG. 6 shows the core plate 100. The core plate 100 has an inlet tank portion 120 for forming an inlet tank, and an outlet tank portion 130 for forming an outlet tank. A fluid passage 110 for forming the tube is U-shaped. One end of the fluid passage 110 is connected to the inlet tank portion 120 through an inlet portion 111 and the other end is connected to the outlet tank portion 130 through an outlet portion 112.

A cross sectional area of the fluid passage 110 is constant from the inlet portion 111 to the outlet portion 112.

A large amount of a liquid-phase refrigerant which has small specific volume is introduced into the fluid passage 110 through the inlet portion 111. The introduced liquid-phase refrigerant evaporates into a gas-phase refrigerant which has large specific volume while it flows in the fluid passage 110 toward the outlet portion 112, so that the flowing velocity of the refrigerant is increased and a pressure loss of the refrigerant is increased as the refrigerant flows toward the outlet portion 112.

SUMMARY OF THE INVENTION

An object of the invention is to make the pressure loss constant in the entire fluid passage. According to the present invention, the cross sectional area of the fluid passage is increased gradually from the inlet portion to the outlet portion.

According to the invention, the cross-sectional area of the fluid passage is increased from the inlet to the outlet. Large ribs which have relatively large flowing resistances are disposed on the fluid passage near the inlet and small ribs which have relatively small flowing resistances are disposed on the fluid passage near the outlet.

According to the invention, the fluid passage is formed symmetrically with respect to a center line of the core plate two of which form a tube. The cross-sectional area of the fluid passage is increased in a flowing direction from the inlet to the outlet.

The liquid-phase refrigerant which has small specific volume comes into the inlet portion of the fluid passage from the inlet tank and the gas-phase refrigerant which has large specific volume comes out through the outlet portion into the outlet tank. There is a difference of the specific volume of the refrigerant at between around the inlet portion and around the outlet portion, however the flowing velocity of the refrigerant and the pressure loss of the refrigerant become constant through the whole refrigerant passage so that the refrigerant flows in the fluid passage smoothly and a heat exchanging efficiency is improved.

The large ribs disposed near the inlet portion disturb the flowing of refrigerant to improve the heat exchanging efficiency and the small ribs disposed near the outlet portion restrain the increment of the pressure loss of the refrigerant.

Since the fluid passage is made symmetrically with respect to the center line of the core plate, it is unnecessary to make two types of the core plates to make a tube.

DESCRIPTION OF THE PREFERRED EMBODIMENTS

The First Embodiment

Figure 1:
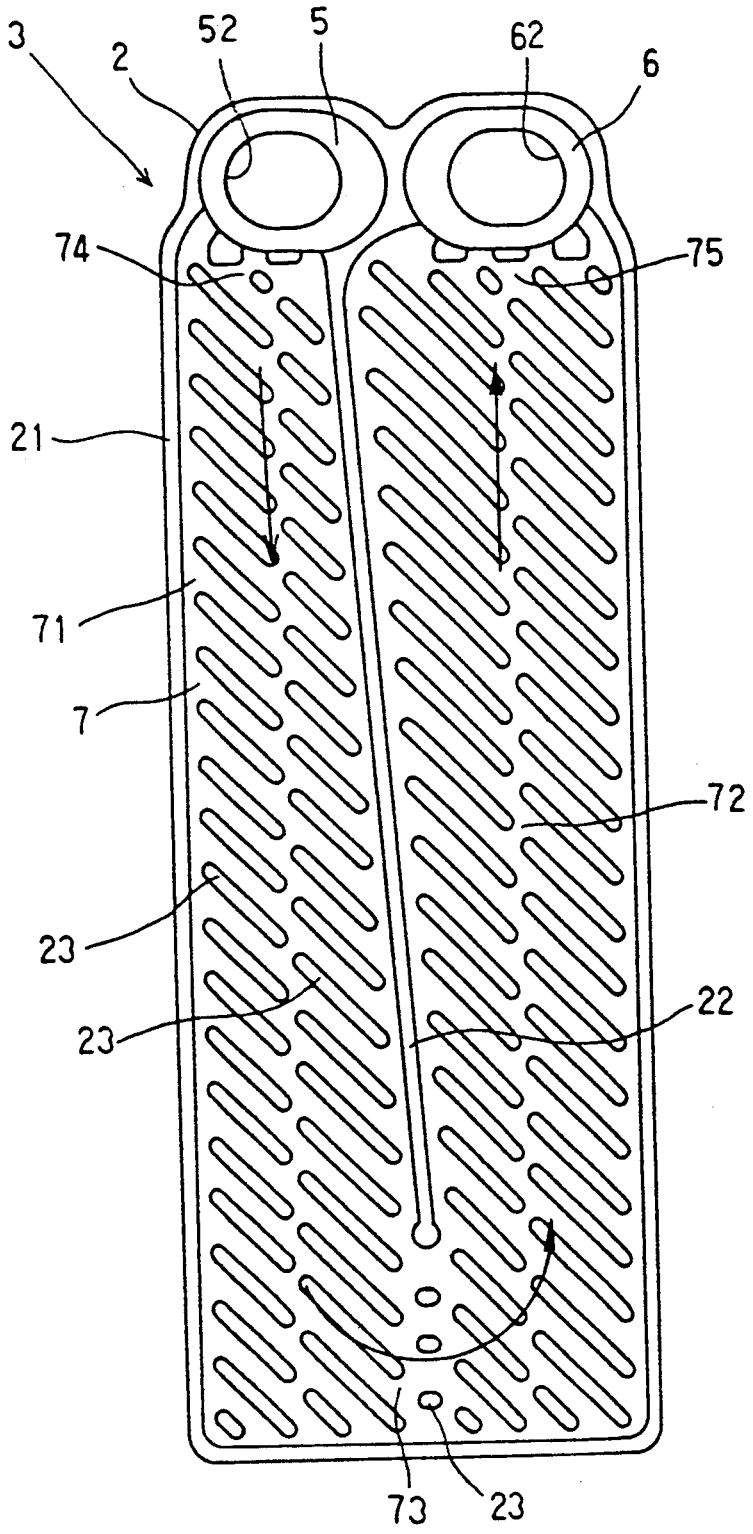
FIG. 1 is a front view of a core plate according to the first embodiment of the present invention.
Figure 2:
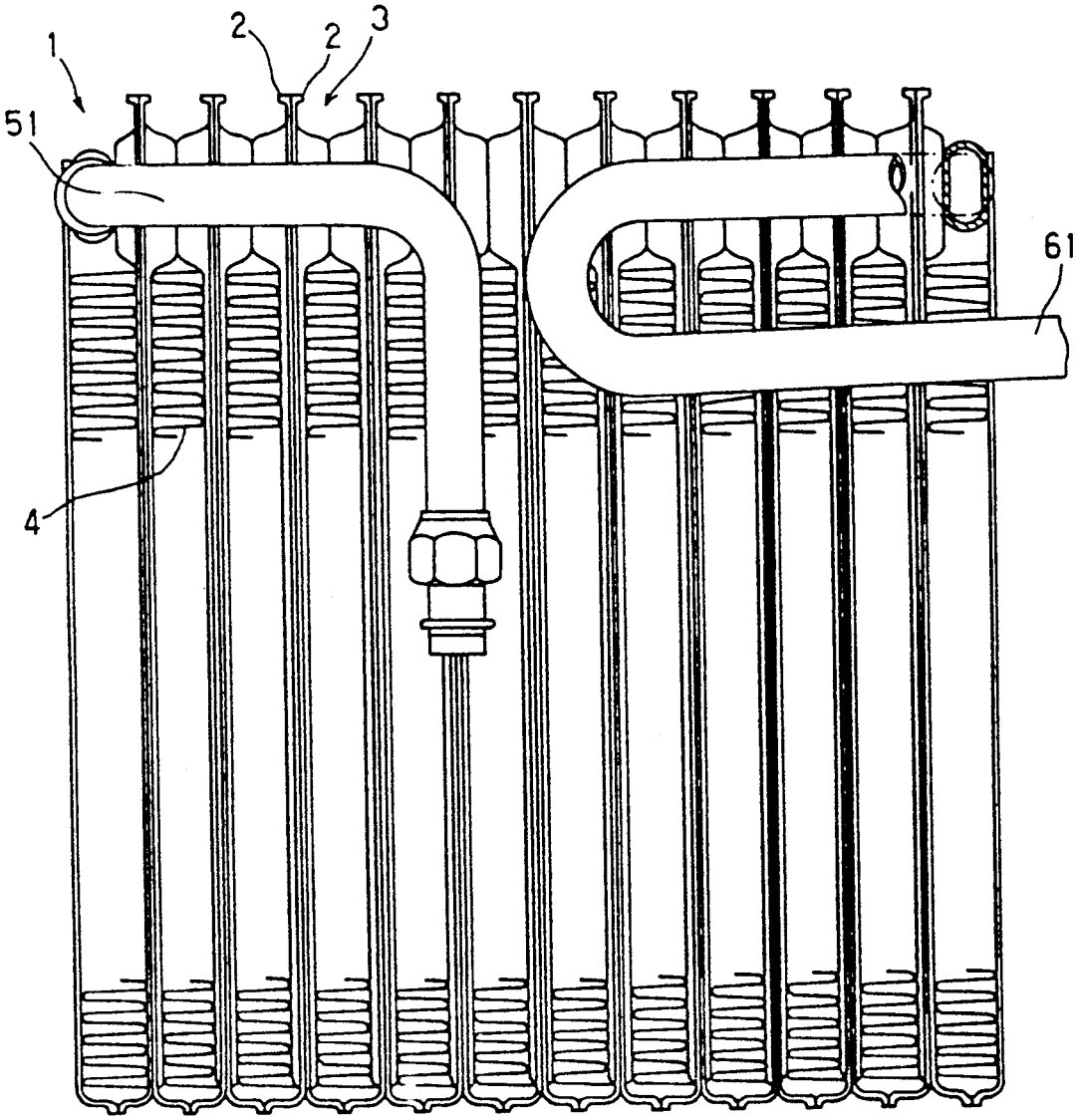
FIG. 2 is a side view of a refrigerant evaporator.

As shown in FIG. 1 and FIG. 2, a plate-type refrigerant evaporator comprises a plurality of tubes 3 and corrugated fin 4 disposed between adjacent tubes. Each tube 3 is constituted by a pair of core plates 2 which are joined to each other by soldering method.

Each core plate 2 is a thin plate made of aluminum and pressed to have concave portions which are used as tank portions 5, 6 and a fluid passage 7. Each core plate 3 has a flat joint surface 21 on a periphery thereof and a central longitudinal partitioning protrusion 22, which is inclined against a longitudinal center line of the core plate 2. The joint surface 21 is joined to the other joint surface of the other core plate and the partitioning protrusion 22 is joined to the other one of the other core plate. A plurality of ribs 23 are provided on the fluid passage 7.

The fluid passage 7 is U-shaped and connected with an inlet tank portion 5 and an outlet tank portion 6 at both ends respectively. The inlet tank portion 5 is oval shaped which a mist-phase expanded by a expansion valve (not shown) is introduced through an inlet pipe 51. The mist-phase refrigerant has a 0.4 fraction which means that the ratio of liquid-phase refrigerant to gas-phase refrigerant is 6 to 4. The mist-phase refrigerant introduced into the inlet tank 5 flows in the fluid passage 7 through an inlet portion 74 toward the outlet tank 6. The inlet tank 5 has an opening 52 which is connected with the other opening of an adjacent tube.

The outlet tank 6 is oval shape and has opening 62 which is connected with the other opening of the adjacent tube. The gas-phase refrigerant which evaporates through the fluid passage 7 flows into the outlet tanks portion 6 and comes out toward a compressor (not shown) through an outlet pipe 61.

The fluid passage 7 is partitioned into the first passage 71, the second passage 72 and the third passage 73, which connects the first passage 71 with the second passage 72. The cross sectional areas of the first passage 71 and the second passage 72 are increased gradually in a flowing direction. The ratio of the cross sectional area of the inlet portion 74 to the outlet portion 75 is approximately 1 to 2. The third passage 73 connects the first passage 71 with the second passage 72 and turns the flowing direction of the refrigerant. Since the specific volumes of the refrigerant at an inlet portion and an outlet portion of the third passage 73 are almost the same. the ratio of cross sectional area of the inlet portion to the outlet portion is 1 to 1 or 0.8 to 1. The flat tubes 3 each of which comprises a pair of core plates 7 are successively stacked in the direction of each flat tube 3.

The operation of this embodiment is described hereinafter. The mist-phase refrigerant is introduce into the inlet tank portion 5 through the inlet pipe 51 after being expanded by the expansion valve. The mist phase refrigerant in the inlet tank portion 5 flows into the first passage 71 through the inlet portion 74 and exchanges heat with the air flowing around the tube 3 as the refrigerant flows through the first passage 71. As the heat exchange is occurred, the amount of gas phase refrigerant is increased. In other words, the specific volume of the refrigerant is increased. Since the cross sectional area of the first passage 71 is increased along the flowing direction, the flowing velocity of the refrigerant is constant even if the specific volume of the refrigerant is increased.

The refrigerant passed through the first passage 71 flows into the second passage 72 through the third passage 73. The amount of the gas phase is increased in the same manner as in the first passage 71 and the specific volume of the refrigerant is also increased. Since the cross sectional area of the second passage 72 is increased from the third passage 73 to the outlet tank 6, the flowing velocity of the refrigerant constant even if the specific volume is increased.

As described above, the flowing velocity of the refrigerant is constant from the inlet portion 74 to the outlet portion 75 and the refrigerant does not stagnate in the fluid passage 7, so that the pressure loss of the refrigerant becomes uniform through the whole fluid passage 7. The refrigerant in the fluid passage 7 flows smoothly and heat exchange efficiency is improved.

In this embodiment, the cross sectional area of the fluid passage is increased gradually, however, the cross sectional area of the fluid passage can be increased in stages. In this case, a plurality of steps are provided on the side of the flat joint surface. 21 or the partitioning protrusion 22.

To increase the cross sectional area of the fluid passage 7, the depth of the passage 7 can be increased instead of increasing the width of the passage 7 as shown in the embodiment described above. The flat joint surface 21 can be inclined against the center line of the core plate 3 to increase the cross sectional area of the fluid passage 7. The shape of the ribs 23 can be varied.

The Second Embodiment

A plurality of round ribs 24 are provided on the second passage 72. The other structural features of the second embodiment are the same as that of the first embodiment. These round ribs 24 are joined to the round ribs 24 of the confronting core plate 3 by a soldering method. The refrigerant which is in the first passage 71 and has a low dryness fraction is disturbed by inclined oval ribs 23 so that heat transfer efficiency is improved. The refrigerant which flows in the second passage 72 has high dryness fraction relatively, however the round ribs 24 reduce the flowing resistance of the refrigerant so that the pressure loss is decreased. The heat transfer efficiency is improved at 20–30% under the same condition wherein the pressure loss of the refrigerant is equal. The total of the contacting area of the round ribs 24 is almost equal to the total of the contacting area of the inclined oval ribs 23, so that there is no difference of strength against pressure between the first passage 71 and the second passage 72.

Figure 3:
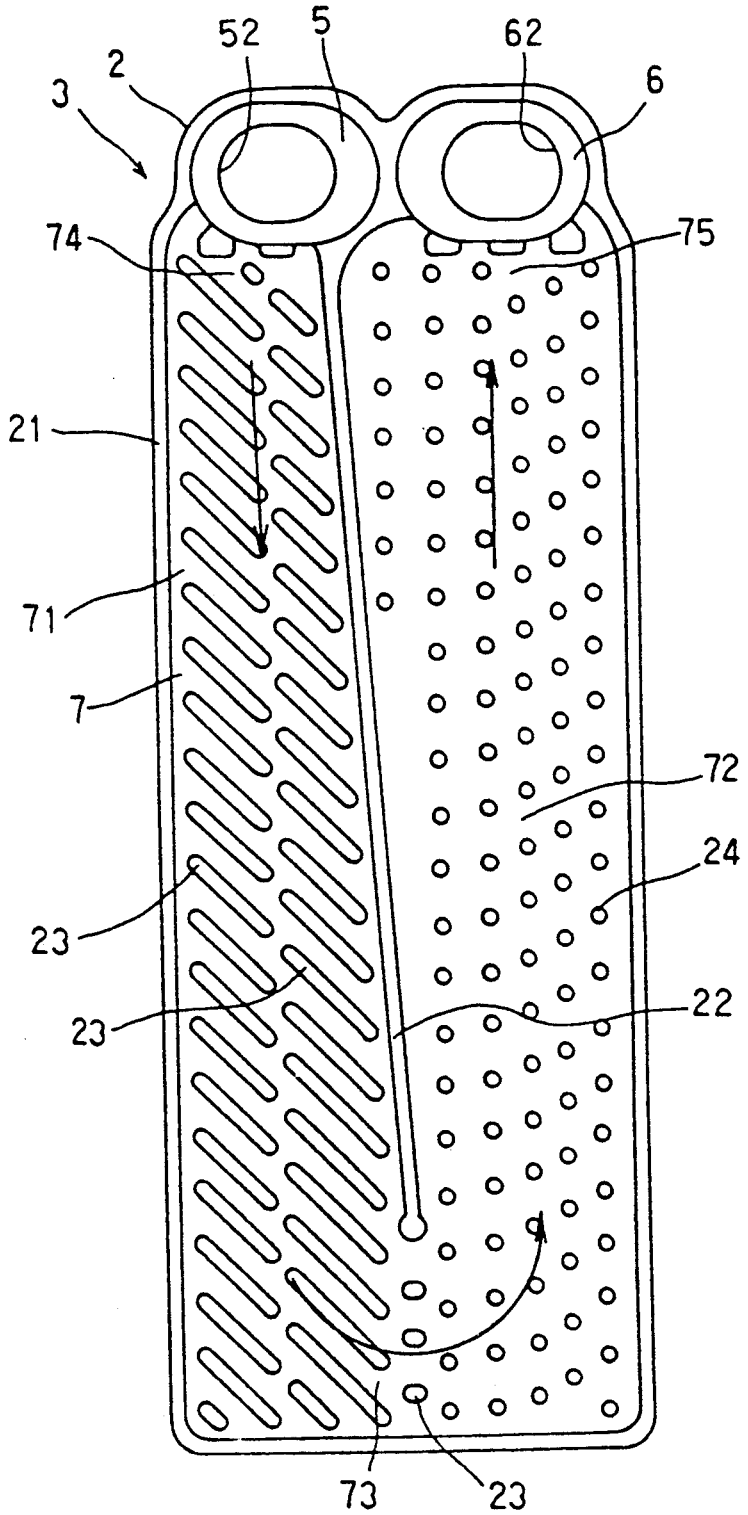
FIG. 3 is a front view of a core plate according to the second embodiment.

The shape of the ribs is not limited to two types shown in FIG. 3 and is altered according to the dryness fraction of the refrigerant which flows thereon. The longitudinal length of the oval ribs 23 can be reduced as they are close to the outlet tank portion 6. The oval ribs 23 and the round ribs 24 can be disposed alternately downstream of the fluid passage 7.

The Third Embodiment

Figure 4:
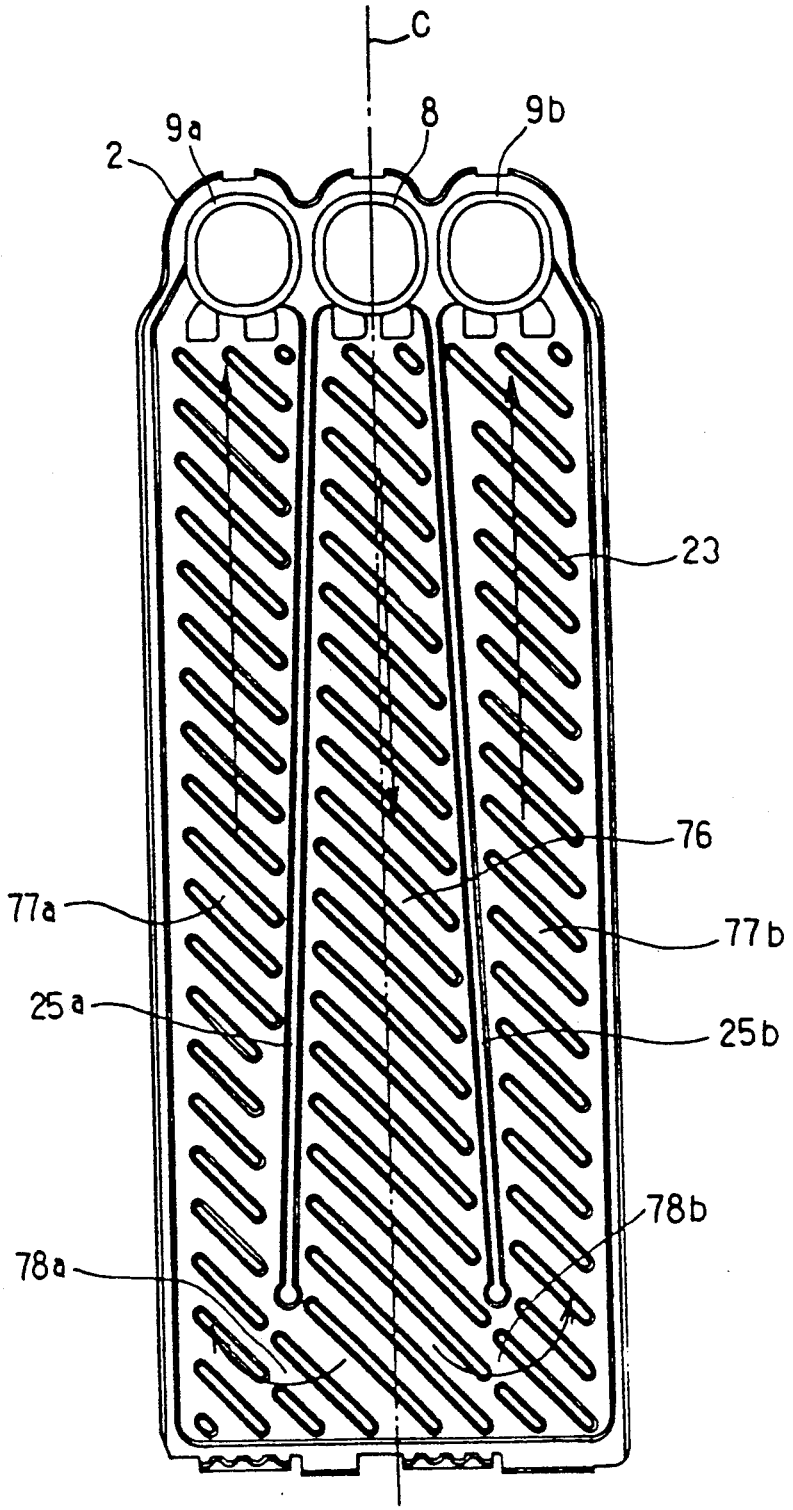
FIG. 4 is a front view of a core plate according to the third embodiment.
Figure 5:
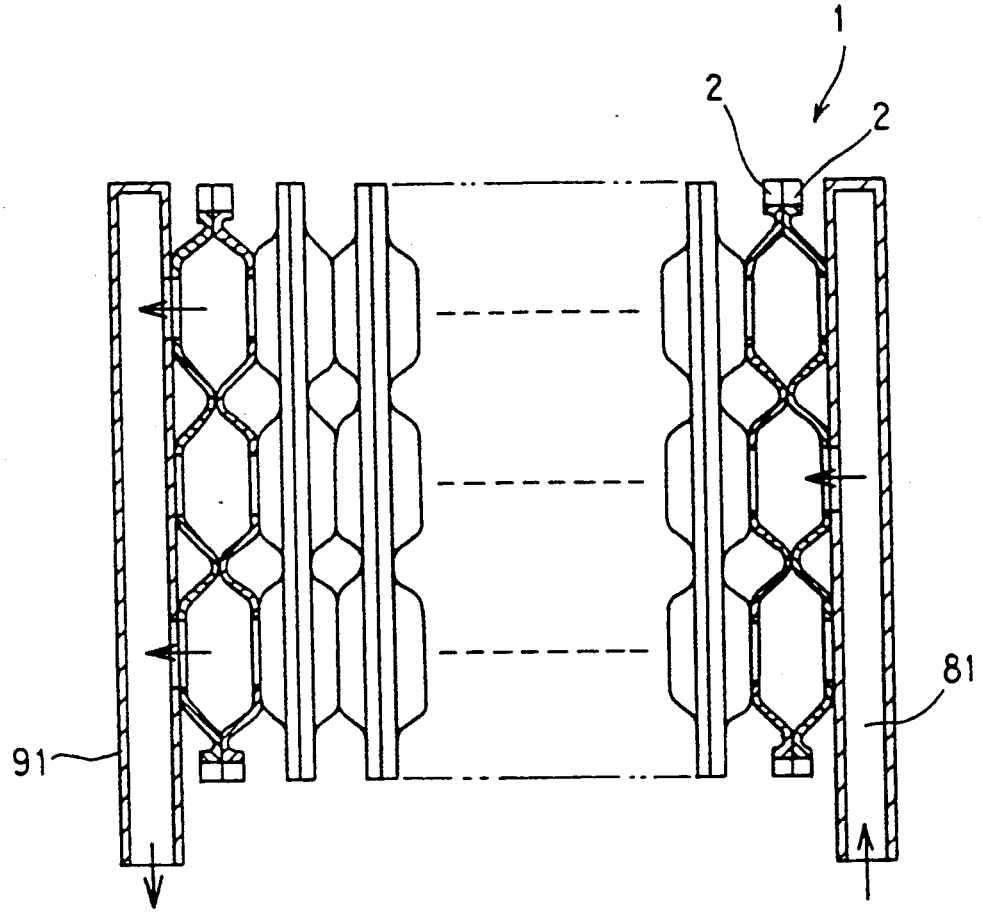
FIG. 5 is a partial cross sectional view showing tanks of an evaporator.
Figure 6:
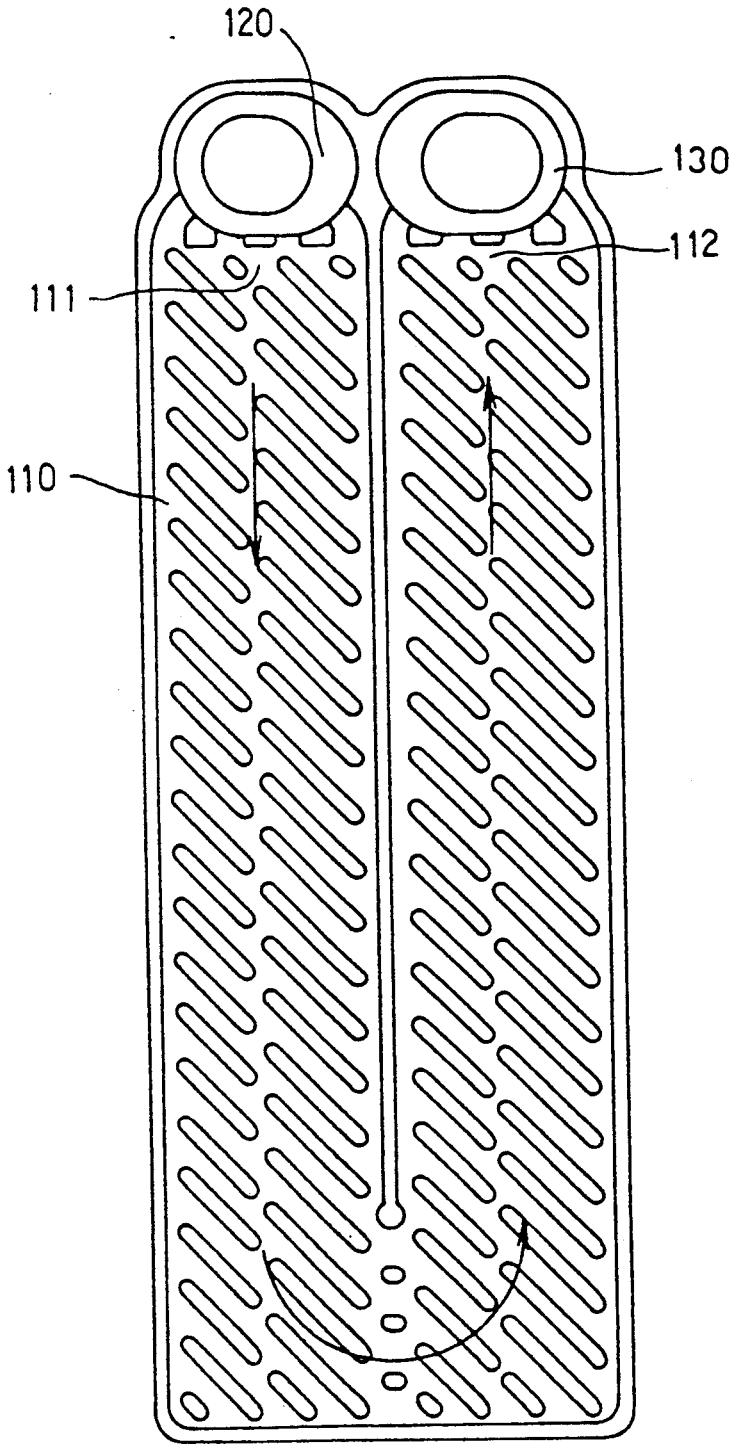
FIG. 6 is a front view of a core plate of a conventional evaporator.

The third embodiment of the present invention is described hereinafter based on FIG. 3 and FIG. 4.

In the first and the second embodiments, since the partitioning protrusion 22 is inclined against the center line of the core plate 3, the core plate 3 is not symmetric with respect to the enter line. To form a tube, a core plate which has symmetric to another core plate is needed.

In this embodiment, an inlet tank portion 8 is provided on the center line C and two outlet tank portions 9*a* and 9*b* are provide on both sides of the inlet tank portion 8. The fluid passage 7 comprises a center passage 76, the first branch passage 77*a* and the second branch passage 77*b*. These two branch passages 77*a*, 77*b* branch at connecting passages 78*a*, 78*b* respectively from the center passage 76. The refrigerant flowing in the center passage 76 is divided into two streams which flow in the first and the second branch passages 77*a*, 77*b*.

The first partitioning protrusion 25*a* and the second partitioning protrusion 25*b* are symmetrical with respect to the center line C. Therefore, two core plates each of which has same shape are joined to form a tube, so that the production cost is reduced. The cross sectional area of the fluid passage is increased gradually in the same manner as in the first and the second embodiments.

A plurality of tubes which comprises two core plate are built up and the inlet pipe 81 and the outlet pipe 91 are connected with tank portions respectively.

The round ribs shown in FIG. 3 can be provided on the core plate 3 of the present embodiment instead of the oval ribs 23.

What is claimed is:

1. A plate-type refrigerant evaporator comprising:

a plurality of flat tubes each formed by two core pates sealingly jointed together;

each flat tube including an inlet tank portion and an outlet tank portion and defining a fluid passage therein, the fluid passage being communicated at its opposite ends with the tank portions and a cross sectional area of the fluid passage being increased along a flowing direction of the refrigerant;

first ribs having a relatively high flowing resistance and being disposed on the fluid passage in a vicinity of the inlet tank portion, second ribs having a relatively low flowing resistance and being disposed on the fluid passage in a vicinity of the outlet tank portion; and a corrugated fin interposed between and secured to adjacent core plates of each adjacent pain of the flat tubes.

2. A plate-type refrigerant evaporator claimed in claim 1 wherein the flat tubes are successively stacked in the direction of each flat tube.

3. A plate-type refrigerant evaporator claimed in claim 1 wherein the flat tubes and the corrugated fin are made of aluminum alloy.

4. A plate-type refrigerant evaporator claimed in claim 1 wherein the flat tubes and the corrugated fins are soldered to each other.

5. A plate-type refrigerant evaporator claimed in claim 1 wherein the first ribs are oval and the second ribs are round.

* * * * *